US006930692B1

(12) United States Patent
Coker et al.

(10) Patent No.: US 6,930,692 B1
(45) Date of Patent: Aug. 16, 2005

(54) MODIFIED WEIGHTED BIT PLANES FOR DISPLAYING GREY LEVELS ON OPTICAL ARRAYS

(75) Inventors: Timothy M Coker, Maidstone (GB); William A Crossland, Cambridge (GB)

(73) Assignee: QinetiQ Limited, London (GB)

( * ) Notice: Subject to any disclaimer, the term of this patent is extended or adjusted under 35 U.S.C. 154(b) by 0 days.

(21) Appl. No.: 09/868,241

(22) PCT Filed: Dec. 16, 1999

(86) PCT No.: PCT/GB99/04260

§ 371 (c)(1),
(2), (4) Date: Aug. 28, 2001

(87) PCT Pub. No.: WO00/38162

PCT Pub. Date: Jun. 29, 2000

(30) Foreign Application Priority Data

Dec. 19, 1998 (GB) ..... 9827944

(51) Int. Cl.[7] ..... G09G 3/36; G09G 5/00; G09G 5/10

(52) U.S. Cl. ..... 345/690; 345/87; 345/89; 345/100; 345/692; 345/211

(58) Field of Search ..... 345/87, 89, 90, 345/690–698, 211, 93

(56) References Cited

U.S. PATENT DOCUMENTS 4,775,891 A * 10/1988 Aoki et al. ..... 348/572
5,815,128 A * 9/1998 Hoshino et al. ..... 345/89
5,867,137 A * 2/1999 Sugiyama ..... 345/89
6,020,869 A * 2/2000 Sasaki et al. ..... 345/89
6,034,664 A * 3/2000 Ali-Santosa et al. ..... 345/593
6,091,398 A * 7/2000 Shigeta ..... 345/204
6,226,054 B1 * 5/2001 Morgan et al. ..... 348/759
6,369,825 B1 * 4/2002 Nakano ..... 345/562
6,369,832 B1 * 4/2002 McKnight ..... 345/691

FOREIGN PATENT DOCUMENTS

EP 0 720 139 7/1996
EP 0 774 745 5/1997

OTHER PUBLICATIONS

Patent Abstracts of Japan, vol. 1, No. 498, Sep. 8, 1993 & JP 05 127612, May 25, 1993.

* cited by examiner

*Primary Examiner*—Regina Liang
*Assistant Examiner*—Duc Q. Dinh
(74) *Attorney, Agent, or Firm*—Nixon & Vanderhye P.C.

(57) ABSTRACT

In a method of multi-level spatial light modulation, using a weighted bit plane technique where an n-digit binary number represents the intended grey level of each pixel location in an array of binary pixels, representative binary numbers are altered to closely adjacent values such as to reduce the inequality of 1s and 0s therein. The method may be applied to a single frame so modifying the gray scale somewhat, or a multi-frame method may be used in which at least some binary numbers are altered to different values in different frames for reducing the inequality of 1s and 0s over the set of frames, while maintaining or approximating the gray scale value as a time average. The methods are particularly useful for maintaining or approximating pixel-wise dc balance in liquid crystal spatial array modulators.

9 Claims, 1 Drawing Sheet

MODIFIED WEIGHTED BIT PLANES FOR DISPLAYING GREY LEVELS ON OPTICAL ARRAYS

This application is the US national phase of International Application No. PCT/GB99/04260, filed Dec. 16, 1999, the entire content of which is hereby incorporated by reference.

BACKGROUND OF THE INVENTION

1. Field of the Invention

The present invention relates to liquid crystal display apparatus, and to methods of operating a display or spatial light modulator, in which the instantaneous intensity distribution afforded by the display or modulator is binary in nature but which is altered in a manner such that the time averaged distribution effectively has, or appears to have, multiple intensity levels. For display purposes, this means that the alteration must be sufficiently fast for averaging to occur at the eye, preferably avoiding any flicker. This requirement may or may not apply for other purposes.

The methods of the invention can be used in conjunction with any spatial light modulator capable of producing a binary image, including those comprising an array of individually addressable cells or pixels, and those where the binary image is produced by scanning of a modulated light beam, for example. The term "binary spatial light modulator" used herein is intended to encompass all such devices, whether they are used for display or other purposes, for example information recordal, and variable components (for example lenses, filters and diffraction gratings) in optical systems. The term is intended to cover passive modulators where an existing light beam is affected by the modulator, and also those which act as light sources, for example arrays of light emitters, and electroluminescent devices. The apparatus of the invention includes a passive binary spatial light modulator in the form of an array of liquid crystal pixels.

2. Discussion of Prior Art

The term "image" as used herein is used to denote any spatially varied light distribution, normally, but not necessarily, of light intensity, and its production or resulting distribution will be referred to by the term "display".

Furthermore, although the term "grey scale" is used herein as denoting a multi-level distribution, it should be made clear that the term is used in relation to any colour, including white. In addition, although the methods, arrays, backplanes, circuitry etc. of the invention and its embodiment are described in relation to a single colour (monochrome images), including white, it is envisaged that variable colour images or displays etc. will be produced in manners known per se, such as by spatially subdividing a single an-ay into different colour pixels, superimposing displays from differently coloured monochrome arrays for example by projection, or temporal multiplexing, for example sequential projection of red green and blue images.

Temporally varying binary modulation to achieve a multiple intensity effect is known, and can be effected by the use of multiple bit planes. In such a scheme, an array of digitised values, of amplitudes corresponding to the grey scale values allocated to the pixels of the array, is decomposed into a multiplicity of bit planes. This multiple bit plane technique may be used with any binary spatial light modulator as defined above.

It is possible to decompose a n-level grey scale image into a plurality of binary image planes of equal duration, with a corresponding plurality of bit planes of equal duration.

However, in a preferred form, known as a weighted bit plane technique, the durations of the bit planes are weighted, each bit plane being representative of one level (exponent) of the digitisation. This reduces the number of bit planes required to synthesise an image, and reduces addressing requirements somewhat. Examples of this technique are to be found in European Patent Application No. 0 774 745 (Matsushita Electronics), and JP 05 127612 (Nippon Hoso Kyokai).

Although in certain cases, it would be possible to use digital bases other than 2, this complicates matters insofar as each bit plane is not binary and thus is not so easily stored. Furthermore, each location of such a bit plane would then have more than one non-zero value, and the variation in non-zero values across the bit plane would need to be taken into account for the durations of operation of each pixel (possibly by further decomposing the non-binary plane to two or more binary planes). The discussion below will be limited to binary weighting, but the principles set out in such a context are believed to be sufficient to enable the skilled person to extrapolate to other exponential bases if required or desired.

Where the digitisation is binary, so that each bit plane is an array of digital 1s and 0s, it is then only necessary to display each bit plane for a total period proportional to its binary weighting to provide a time averaged image equivalent to the digitised grey scale image.

Where possible, it is convenient to display each binary bit plane once for the total duration necessary to contribute to the grey scale image, but it is also possible to display one or more of the bit planes a plurality of times, not necessarily sequentially, provided that the total time spent in displaying each bit plane, relative to the total time spent in displaying all the bit planes, is proportional to its binary weighting.

Recently there has been developed a novel spatial light modulator in the form of a smectic liquid crystal layer disposed between an active semiconductor backplane and a common front electrode. It was developed in response to a requirement for a fast and, if possible, inexpensive, spatial light modulator comprising a relatively large number of pixels (320×240 up to 640×480) with potential application not only as a display device, but also for other forms of optical processing such as correlation and holographic switching. Depending on the manner in which it is driven, and the value of the applied voltage, the modulator may be driven at a line rate of at least 10 MHz and a frame rate of up to 15 to 20 kHz, requiring a data input of around 1 to 1.5 Gpixel per second Typically, while the pixel address time is around 100 nanoseconds, the pixel will actually take around 1 to 5 microseconds to switch between optical states; and while overall frame writing time is of the order of 24 microseconds, the frame to frame writing period is around 80 microseconds.

This spatial light modulator can be driven according to single pass schemes, in which the front electrode is placed at a potential of V/2 relative to the backplane pixels, which are switched to zero volts or V volts.

Alternatively it can be driven according to double pass schemes in which in one pass the front electrode is placed at zero volts and selected pixels are turned ON by switching pixel elements of the backplane array to V volts, and in the other pass the front electrode is placed at V volts and selected pixels are turned OFF by switching elements of the array to zero volts. For pixels which are not in the process of being switched the elements of the backplane follow the voltage of the front electrode. To maintain the same potential difference therebetween, the voltage at all backplane pixel elements of the array is simultaneously switched as the voltage on the front electrode is changed between zero and V volts.

Our copending International Patent Applications (PCT/GB99/04285, ref: P20957WO, priority GB9827952.4; PCT/GB99/04286 and PCT/GB99/04276,. refs: P20958WO and P20958WO1, both priority GB9827965.6; PCT/GB99/04282, ref: P20959WO, priority GB9827900.3; PCT/GB99/04279, ref: P20960WO, priority GB9827901.1; PCT/GB99104274, ref: P20961WO, priority GB9827964.9; PCT/GB99/04275, ref: P20962WO, priority GB9827945.8; and PCT/GB99/04277, ref: P20963WO1, priority GB 9827944.1) relate to other inventive aspects associated with this spatial light modulator, including the single and double pass schemes referred to in the preceding paragraph The aforesaid spatial light modulator is ideally suited to the use of the bit plane technique mentioned above. However, the present invention is not limited to liquid crystal modulators, but can be applied to any spatial light modulator as referred to above.

One problem which arises, particularly when operating liquid crystal display and modulators, is that of maintaining a dc balance at individual pixels. Initially, liquid crystal light modulators were in the form of a single cell comprising a layer of liquid crystal material sandwiched between opposed electrode bearing plates, at least one of the plates being transparent. Such cells were slow to operate and tended to have a short life due to degradation of the liquid crystal material. Quite early on it was recognised that the application of an average finite dc voltage to the liquid crystal cell was not beneficial, and at least in some cases produced degradation by electrolysis of the liquid crystal material itself, and schemes were evolved to render the average dc voltage to zero (dc balance).

It is now appreciated that other effects are also at work when a dc voltage is applied. When driving liquid crystal electro-optic devices for any length of time, a phenomenon known as image sticking may occur. Although the precise cause of this effect is unknown, there are theories that ions are trapped or a space charge is induced within the material in response to an overall dc field, and this results in a residual field even when the external dc field is removed.

It is evidently desirable that the time averaged voltage (that is, the average over the time that the voltage is actually being applied from an external source to the liquid crystal) applied to a liquid crystal material is zero, whether to avoid degradation or to avoid image sticking.

SUMMARY OF THE INVENTION

The present invention is directed to a weighted bit plane technique as described above in which at least some of the bit planes are modified. It has particular but not exclusive relevance to the production of effective grey scale intensity distributions for display purposes, where the effective duration of the binary images (length and/or number of repeats) is such that temporal integration thereof, for example by a viewer, gives the grey scale image. The methods of the invention find particular but not exclusive application to liquid crystal spatial light modulators.

The different bit planes for a grey scale image can be stored as sequential binary strings in a computer, and will be read out one at a time in any desired order after which they can be discarded unless the image needs to be repeated. It is computationally easiest to read out the bit planes in the order in which they have been stored, since then the only address which needs to be stored is the starting address of the first stored bit planes, all bit planes then being read out one at a time simply by clocking out a predetermined number of data bits in sequence for each bit planes.

It might be possible immediately to replace bit planes that have been read by the bit planes for a succeeding image, particularly where the bit planes are being produced in real time. However, under other circumstances this could be difficult, and the set of bit planes for a successive image will then normally be stored elsewhere. In certain cases it would be possible to provide storage for just two bit planes one of which is written while the other is being read, and vice versa.

It would also be possible to control the reading and/or writing processes so as to convert the image standards as desired, for example from line sequential to interlaced.

As or after each bit plane is read from memory, it is then written, e.g. using the single pass scheme described above, and viewed over a period corresponding to its weighting so that the eye synthesises the intended grey scale image. The single pass scheme is preferred insofar as it merely overwrites the preceding bit frame without the need for a second pass, the associated front electrode switching and blanking pulses. The avoidance of lost time between successive valid images enables continuous illumination and the easier provision of bit frames of an accurately weighted duration.

In such a scheme, each pixel is subjected to a series of voltage pulses according to the point in the grey scale it represents (as in the number representing the grey scale level, and usually but not necessarily in that order). There are more points in the grey scale than there are applications of voltages, due to the weighting employed, which is advantageous since it reduces the time spent actually driving the array. Each applied voltage may be of the same or opposed polarity compared to the preceding voltage, and the same number of voltage pulses, equal to the number of bit planes (ignoring polarity), is applied to each pixel to synthesise the image.

For example, in a 64 level grey scale with binary weighting, there will be 6 bit planes with relative durations of $2^n t$ where n ranges from 0 to 5, and each pixel can be represented by a corresponding 6 digit binary number.

However, double pass schemes could alternatively be adapted for use in multiple or weighted bit plane schemes.

To achieve dc balance, it would be possible to produce each binary bit plane by any binary imaging method which itself produces dc balance—for example by starting from a blank image, writing, viewing and erasing the binary image by selective energisation (+V) and driven blanking (−V) of selected pixels only.

However, in most or all of such schemes, the actual duration of the binary image is not directly proportional to the time allocated thereto, for example because of intervening blanking steps, etc., leading to a degree of distortion in the binary nature of the bit plane periods, and hence the perceived grey scale values. While this could be compensated for if desired, it represents an additional complication.

The present invention provides multiple or weighted bit plane apparatus and methods in which dc balance is approached or achieved in ways other than by employing dc balanced binary images per se, including the alteration of a number or numbers representing pixel intensity. Features and advantages of the invention will become clear upon a reading of the following description, and also upon perusal of the appended claims to which the reader is directed.

DETAILED DISCUSSION OF EMBODIMENTS

Figure 1:
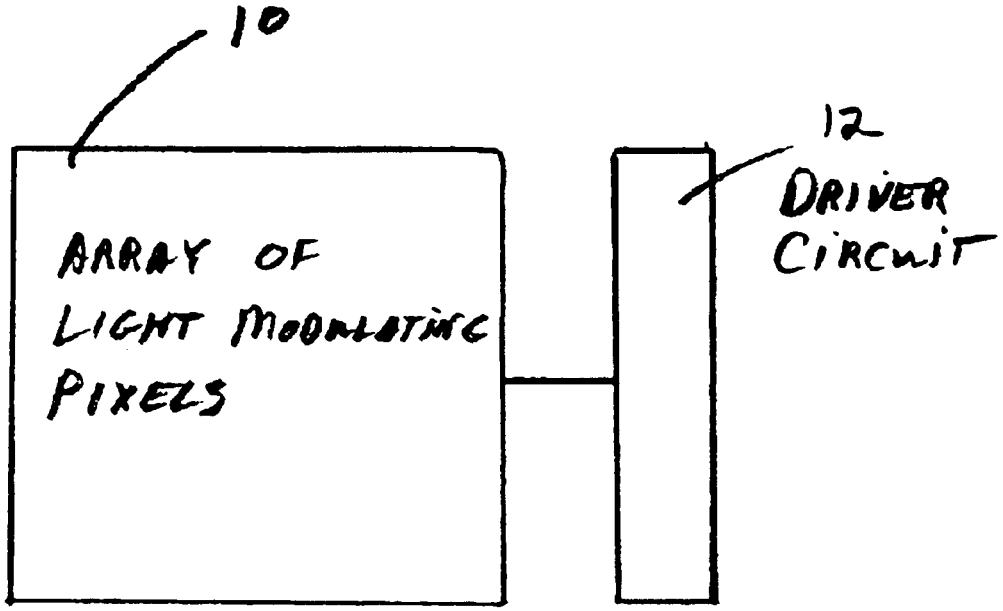
FIG. 1 shows a schematic of a light modulating apparatus according to present invention.

FIG. 1 shows a light modulating apparatus which has an array 10 of light modulating pixels, each pixel being arranged to be driven by a drive means 12.

For any selected pixel, each grey scale level can be represented by a binary number, and there are certain binary numbers which possess equal numbers of 0 and 1 digits, for example 111000 and 010101. In these cases the average dc voltage over the 6 bit planes will be zero. Other binary numbers, such as 011000 and 010001 come close to this ideal, and others, in particular 111111 and 000000 are far removed therefrom.

Thus to achieve dc balance in such a scheme, another possibility is (*a*) to use only those numbers which by themselves achieve dc balance, or (*b*) at least to alter the grey scale nunmbers to closely adjacent numbers which closely approach de balance. This permits use of a single or double pass scheme (see above, and also our copending applications PCT/GB99/04274 and PCT/GB99/04275), addressing all elements during each scan. Some of these schemes per se normally provide no inherent dc balance, and yet in this case dc balance or at least an approximation thereto can be obtained over the grey scale imaging time.

In operation according to the invention in the first instance (*a*), where the desired grey level differs, it is approximated by the nearest such number in value, for example 000110 becomes 000111, and 100010 becomes 100011. A drawback is that there can be significant distortion of the greyscale.

In the second instance (*b*), distortion of the greyscale can be reduced but at the expense of precise dc balance. For example, the number 001000 may become 001001, and 10111 may become 10110.

In either instance, unless further corrective steps are taken, extreme values of the grey scale will be omitted (e.g. replaced by an adjacent less extreme value), thus reducing or compressing the contrast range somewhat.

European Patent Application Serial No. 0 720 139 (Pioneer Electronic Corporation) discloses a method for correcting grey scale data for a weighted bit plane technique in which the numbers indicative of pixels intensity are altered in a manner intended to prevent false contouring which otherwise arises in a self luminous display, such as an electroluminescent or plasma display. In such a case, the alteration at any pixel can reduce, maintain or increase the inequality of 1s and 0s, and in the latter case dc balance will deteriorate fuither, and it is believed that false contouring is a problem peculiar to self-luminescent displays, as opposed to passive liquid crystal displays.

In a first aspect the invention provides a method of image signal processing for a weighted bit plane technique, in which an image signal represents a set of n-digit binary number signals each indicative of the intended intensity level of a respective one of a corresponding array of binary pixels, wherein at least one said binary number has an inequality of 1s and 0s, characterised in that said method comprises the step of altering the said at least one binary number to a closely adjacent value to reduce or by remove the said inequality therein and so that any inequality of 1s and 0s in each of said set of numbers is left unchanged, reduced or removed In a second aspect the invention provides a method of writing and displaying an image in response to an image signal representing a set of n-digit binary numbers each indicative of the intended intensity level of a respective one of a corresponding array of binary pixels, a complete image being wrtten using a weighted bit plane technique, the method being characterised in that at least one said binary number is altered to a closely adjacent value such that over the writing of said complete image an inequality of 1s and 0s at the corresponding pixel is reduced or removed and so that any inequality of 1s and 0s at pixels for each of the rest of the said set of numbers is left unchanged, reduced or removed.

The methods according to the first and second aspects of the invention (and also that of the fourth aspect-see below) is in fact particularly useful when driving an array of liquid crystal pixels.

In a third aspect the invention provides light modulating apparatus comprising an array of light modulating pixels and drive means adapted to drive the array to write a complete image by a weighted bit plane technique in response to an image signal representing a set of ndigit binary numbers defining the intended intensities of respective pixels of the array, n being an integer greater than one, charactersed in that the pixels are liquid crystal pixels, and the driving means is arranged to alter the n-git number in respect of at least one said pixel to a closely adjacent value so that the numbers of 1s and 0s written thereat over said writing of a complete image are brought closer to equality whereby to improve the dc balance.

In the weighted bit plane technique the driving means may provide from the image signal a group of n binary bit plane signals each representative of a respective digit from each of the set of numbers, i.e. a respective exponent of digitisation, and write the display with each bit plane signal at least once in a predetermined sequence and with predetermined tings to thereby write a complete image with integrated pixel intensities substantially corresponding to said image signal.

In a refinement, time averaging of both dc and grey scale level is performed over more than one frame, by suitable choice of the binary numbers. In this manner, dc balance can be closely approximated, or preferably attained, while the average grey scale level can be approximated or, preferably, maintained. For example, 110110 (27) could be replaced by 001110 (28) in a first frame and by 010110 (26) in second it frame. The average grey scale level is 27 as desired, and both the binary numbers actually used provide dc balance per se.

In a more complicated example, the grey scale level 15 (11100) could be used twice together with an additional frame for grey level 14 (011100) and another additional frame for grey level 16 (000010), the frames in any desired order. Over the four frames the average grey level is 15, and there are equal numbers of binary 1s and 0s.

Accordingly in a fourth aspect the invention also provides a method of writing and displaying an image in response to an image signal representing a set of n-digit binary numbers each indicative of the intended intensity level of a respective one of a corresponding array of binary pixels, using a weighted bit plane technique, wherein at least one said binary number produces an inequality of 1s and 0s at its pixel over the writing of a complete image, characterised in that a plurality of images each approximating said complete image are written in succession, and the said at least one binary number is altered to a closely adjacent value in at least one of said plurality of images so that over said succession the said inequality of 1s and 0s is reduced or removed and any inequality of 1s and 0s at each of the other pixels is left unchanged, reduced or removed. Preferably the inequality in said at least one pixel is elininated. The average intensity over the plurality of images is at least approximated, but preferably maintained.

In a fifth aspect the invention provides light modulating apparatus comprising an array of light modulating pixels and drive means adapted to drive the array to write a complete image by a weighted bit plane technique in response to an image signal representing a set of n-digit binary numbers defining the intended intensities of respective pixels of the array, n being an integer greater than one, characterised in that the pixels are liquid crystal pixels, and over a plurality of successive said complete images the driving means is arranged to alter the n-digit number in respect of at least one said pixel in at least one said complete image to a closely adjacent value so that the numbers of 1s and 0s written at said at least one said pixel over the plurality of images are brought closer to equality whereby to improve the dc balance.

Again extremes of the grey scale are preferably omitted. If in either case, the full grey scale ranges are retained, dc balance can be periodically restored by other means, for example by applying corrective dc pulses as appropriate following a computer simulation of the dc imbalance which has accumulated, as mentioned above. However, this is not normally preferred, since it potentially involves using a number of corrective dc pulses equal in number to the number of bit planes which have been used, to allow for the possibility that at least one pixel has remained at an extreme grey scale value throughput the imaging period.

These ways of maintaining dc balance in grey scale imaging arise at least in part from the reduction in number of address steps compared with the number of grey scale levels. One way of deriving the grey scale value or combinations of grey scale values for use in operation of the multiple or weighted bit plane scheme, that is, replacing the input grey scale value derived from the intended image itself, is by means of a look-up table.

The weighted bit plane method as operated above does require that relaxation of the pixels is negligible over the duration of the longest bit plane, and this is not always possible, particularly in the case of liquid crystal pixels. In such a case, the bit planes can be refreshed during the bit plane period(s), but at the possible expense of dc balance. Nevertheless there are advantages in the ease of obtaining an accurately simulated grey scale.

Basically, a refresh step comprises repeating the application of the same voltage as was applied at the start of the bit plane so as to restore the switched state of the pixel. It may even be that the nth power binary weighted bit plane needs to be refreshed $(2^{n-1}-1)$ times subsequent to the first writing so that a $(2^n-1)$ greyscale will involve $2^{n-1}$ frame writes of binary images when the refresh writing stages are included. However, the increasing number of writing steps makes it increasingly difficult to alter the bit frames according to the invention in the direction of providing dc balance, and in the limit of $2^{n-1}$ frame writes (where the lowest order bit plane is the only one not refreshed), the present invention cannot be successfully applied However, there will be occasions where refreshing is only necessary with the longer duration bit planes. In such a case it would be again be possible to practice a method according to the present invention, using the actual binary numbers describing the pixel as previously described. However, a preferred method according to the invention is practised by taking detrmng the aggregate of the 1s and 0s occurring over the whole frame (single image method) or frames (plural image method), including the refreshed values, and altering the number for a pixel having an inequality of 1s and 0s so determined as to reduce the inequality. That is, that this preferred method acts on the binary numbers for each pixel as expanded according to the need to refresh.

For example, taking a simple example of pixels represented by a binary number comprising only four digits per pixel, where the first two, higher order, digits need to be refreshed, but the 3rd and 4th can be displayed without the need to refresh, it will be necessary to refresh the longest bit plane four times and the next longest twice.

Taking the number 1001, this then becomes (1111)(00)01, where the brackets demarcate the original digits, having 5 unit values but only three zeros. Conversion of the original number to 1000 gives equality of values in the expanded number (11110000).

In the refresh scheme, bit planes are read out more than once, depending on the duration thereof. Thus it is not possible to discard the bit plane until it has undergone its final reading. Furtlermore, if each bit plane is repeatedly read for the requisite number of times before proceeding to the next bitframe, it is necessary to store the starting address of the two bit planes.

For example, taking a simple case of three bit planes A, B and C, of relative durations 4t, 2t and t respectively, it would be possible to read these out in the order AAAABBC. However, this necessitates storing the start addresses of each of the bit planes, apart from frame C which is read only once, in order that the correct place for the refresh readout may be reached.

In addition, and perhaps more importantly, there are cases where it is necessary to rewrite the entire grey scale image before proceeding to a new image, where display times are long or relaxation is fast for example. In such a case it is necessary not only to store the start address of the bit plane next to be used, but also the start address of the first bit plane of the entire sequence, until that image information is no longer required.

An improved method of readout in such cases makes it possible to avoid the storage of a plurality of start addresses. At the high speeds involved in reading out the images when using the spatial light modulator of the preferred embodiment, this apparently minor step can be computationaUy significant and advantageous.

Essentially, a plurality of the highest order bit planes (or all the bit planes), are stored as binary strings in sequential locations in a memory, in decreasing order of intended duration (weighting), a predetermined number of read passes are made from the set of stored bit planes equal to the plurality of weighted bit planes, each pass commencing with the highest order bit plane and continuing along the stored bit planes in sequence, the lengths of the sequences being selected and varied such that at the end of the predetermined number of read passes each bit frame has been read out a plurality of times proportional to or equal to its duration (weighting). This general method of fast readout forms the subject of our copending International Patent Application No. PCT/GB99/04277 filed on the same day as this application Thus according to this scheme, the triple bitframe image exemplified above will be read out with read passes ABC (once), AB (once), and A (twice), which when combined can give an overall order, for example, of ABCABAA, or ABCAAAB or ABAAABC as desired. Only the start address needs to be stored since each read pass commences at the same place, and continues to an address determined by counters.

Where grey scale imaging is practised according to the invention, but with refreshing of a plurality of the highest order bit planes, it is possible to apply this fast readout method to the set comprising the bit planes which are refreshed plus the next lowest order bit plane. Any remaining lower order bit plane(s) which are not refreshed will be read out once, for duration(s) less than the lowest order bit plane of the set according to their weighting. This can be done at any time, including a period or periods within the reading out of the plurality, but is preferably performed before or after the entire set has undergone a fast readout.

While some of the grey scale and refresh schemes above automatically provide dc balance, a firther option for schemes which do not do this is to allow dc imbalance to accumulate, for example while writing images and then allowing them to relax, calculating the imbalance (e.g. in an accompanying computer simulation), and then applying local dc voltages to the pixels of a magnitude and duration such as to provide zero average dc.

It should be understood that there have been references above to a liquid crystal cell incorporating an addressable array, the methods of the invention may be used in relation to any binary spatial light modulator. Where the imaging device is a liquid crystal device, prolongation of the binary images used to synthesise the grey scale image may be achieved in known manner by the application of a small ac field between successive binary images.

What is claimed is:

1. A light modulating apparatus comprising:

an array of light modulating pixels; and drive means adapted to drive the array to write a complete image by a weighted bit plane technique in response to an image signal representing a set of n-digit binary numbers defining the intended intensities of respective pixels of the array, n being an integer greater than one, wherein the pixels are liquid crystal pixels, and the driving means is arranged to alter the n-digit number in respect of at least one said pixel to a closely adjacent value so that the numbers of 1s and 0s written thereat over said writing of a complete image are brought closer to equality thereby improving the dc balance.

2. A light modulating apparatus comprising:

an array of light modulating pixels; and drive means adapted to drive the array to write a complete image by a weighted bit plane technique in response to an image signal representing a set of n-digit binary numbers defining the intended intensities of respective pixels of the array, n being an integer greater than one, wherein the pixels are liquid crystal pixels, and over a plurality of successive complete images the driving means is arranged to alter the n-digit number in respect of at least one said pixel in at least one said complete image to a closely adjacent value so that the numbers of 1s and 0s written at said at least one said pixel over the plurality of images are brought closer to equality thereby improving the dc balance.

3. A light modulating apparatus according to claim 2 wherein said driving means is arranged so that values of said number over said plurality of images provide an average intensity at said at least one pixel substantially equal to the intended intensity.

4. A light modulating apparatus according to one of claims 1–3, wherein said driving means is arranged so that said numbers of 1s and 0s written at said at least one said pixel are brought to equality.

5. A light modulating apparatus according to one of claims 1–3 wherein said driving means includes a look-up table for determining how said at least one number is to be altered.

6. A method of image signal processing for a weighted bit plane technique, in which an image signal represents a set of n-digit binary number signals each indicative of the intended intensity level of a respective one of a corresponding array of binary pixels, wherein at least one said binary number has an inequality of 1s and 0s, wherein said method comprises the step of altering said at least one binary number to a closely adjacent value to at least reduce said inequality therein.

7. A method of writing and displaying an image in response to an image signal representing a set of n-digit binary numbers each indicative of the intended intensity level of a respective one of a corresponding array of binary pixels, a complete image being written using a weighted bit plane technique, the method comprising the step that at least one said binary number is altered to a closely adjacent value such that over the writing of said complete image an inequality of 1s and 0s at the corresponding pixel is at least reduced.

8. A method of writing and displaying an image in response to an image signal representing a set of n-digit binary numbers each indicative of the intended intensity level of a respective one of a corresponding array of binary pixels, using a weighted bit plane technique, wherein at least one binary number produces an inequality of 1s and 0s at its pixel over the writing of a complete image, wherein said method comprises the steps of:

writing a plurality of images each approximating said complete image in succession; and altering said at least one binary number to a closely adjacent value in at least one of said plurality of images so that over said succession the said inequality of 1s and 0s is at least reduced.

9. A method according to claim 7 or claim 8 wherein at least one bit plane is refreshed during the writing of a said complete image.

* * * * *